United States Patent [19]

Stillman et al.

[11] Patent Number: 4,701,286

[45] Date of Patent: Oct. 20, 1987

[54] APPARATUS FOR DISPENSING A WATER TREATING COMPOSITION INTO THE RECIRCULATING WATER OF AN EVAPORATIVE SYSTEM

[75] Inventors: Neil W. Stillman; John T. Geiger, both of Milwaukee, Wis.

[73] Assignee: Applied Biochemists Inc., Mequon, Wis.

[21] Appl. No.: 744,693

[22] Filed: Jun. 14, 1985

[51] Int. Cl.[4] ..... B01F 3/04

[52] U.S. Cl. ..... 261/36.1; 62/310; 62/314; 222/501; 239/379; 261/71; 261/72.1; 261/106; 261/DIG. 3; 261/DIG. 46

[58] Field of Search ..... 261/106, 71, 72 R, 64 R, 261/103, 36 R, DIG. 11, DIG. 3, DIG. 15, DIG. 41, DIG. 46, DIG. 17; 239/37, 43, 378, 379; 210/749, 198.1; 222/501; 62/304, 310, 314

[56] References Cited

U.S. PATENT DOCUMENTS

| | | | |
|---|---|---|---|
| 149,135 | 3/1874 | Knight | 261/71 |
| 1,141,796 | 6/1915 | Hertzog | 261/106 |
| 1,273,682 | 7/1918 | Slater et al. | 239/43 X |
| 3,126,427 | 3/1964 | Broughton | 261/DIG. 46 |
| 3,169,705 | 2/1965 | Geiger | 239/43 |
| 3,196,892 | 7/1965 | Savage et al. | 261/DIG. 11 |
| 3,857,909 | 12/1974 | Huggins | 261/64 R |
| 4,172,105 | 10/1979 | Miller et al. | 261/72 R X |
| 4,271,095 | 6/1981 | Maeda | 261/71 X |
| 4,276,241 | 6/1981 | Stewart et al. | 261/DIG. 46 |

FOREIGN PATENT DOCUMENTS

| | | | |
|---|---|---|---|
| 348819 | 6/1937 | Italy | 261/71 |

*Primary Examiner*—Richard L. Chiesa

*Attorney, Agent, or Firm*—Andrus, Sceales, Starke & Sawall

[57] ABSTRACT

An apparatus for dispensing a water treating composition into the recirculating water of an evaporative system, such as an evaporative cooler. The water treating composition is contained in a container that is suspended in an inverted condition within the housing of the evaporative cooler with the outlet of the container facing downwardly. One end of a drip line is connected through a sealed closure to the interior of the container, and the opposite end of the drip line terminates above the level of water in the reservoir of the evaporative cooler. A manually adjustable needle valve is connected in the drip line and controls the gravity feed of the liquid composition through the drip line to the reservoir. Through the addition of the treating composition, scaling problems in the evaporative system are minimized, corrosion is eliminated and growth of bacteria and algae is inhibited.

1 Claim, 2 Drawing Figures

APPARATUS FOR DISPENSING A WATER TREATING COMPOSITION INTO THE RECIRCULATING WATER OF AN EVAPORATIVE SYSTEM

BACKGROUND OF THE INVENTION

Evaporative coolers are used for cooling residences and commercial buildings in warm, dry climates such as the southwestern portion of the United States. The conventional evaporative cooler, which is normally mounted on the roof of the building, includes a housing that contains a blower that draws air into the housing through one or more inlets and discharges the air to the area to be cooled. The inlets are enclosed by evaporative pads and water, from a reservoir, is continuously flowed downwardly over the pads. The evaporation of the water produces a cooling effect to cool the air being drawn into the building.

As the water is being continuously evaporated, scale formation is a problem, particularly in areas of hard water, with the result that the pads must be frequently cleaned to maintain the efficiency of the cooler. However, as most evaporative coolers are located on the roof in a relatively inaccessable location, and as the roof may be subjected to extreme heat during the summer, maintenance of the pads is frequently neglected with the result that the efficiency of the cooling operation is greatly reduced.

As a further problem, algae and bacteria can collect in the reservoir of the cooler resulting in foul odors being transmitted to the building as well as constituting a potential health hazard.

SUMMARY OF THE INVENTION

The invention is directed to a method and apparatus for dispensing water-treating chemicals into the recirculating water of an evaporative system, such as an evaporative cooler. In accordance with the invention, the liquid treating composition is contained in a plastic container or bottle which is suspended in an inverted condition within the housing of the cooler, with the outlet of the bottle facing downwardly. One end of a drip line is connected through a sealed closure in the outlet of the container, while the opposite end of the drip line is positioned slightly above the level of water in the resevoir of the cooler.

To control the flow of the liquid through the drip line, a manually adjustable needle valve mechanism is incorporated in the drip line. Through adjustment of the valve, the water treating composition will be automatically delivered to the reservoir in a controlled amount.

The addition of the treating chemical will act to prevent scaling to thereby maintain proper air flow through the pads and retain the efficiency of the cooling operation. By preventing scale formation, maintenance of the cooler is substantially reduced.

The treating composition can also contain corrosion inhibitors which will reduce the corrosion of steel or galvanized components of the cooler.

By incorporating bacteriacides and/or algaecides in the treating composition, the growth of algae and bacteria is inhibited which eliminates the stale air problems normally associated with evaporative coolers.

The dispensing equipment can be housed entirely within the casing of the evaporative cooler and the container has a volume sufficient to treat the water for substantial periods of time without operator attention.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
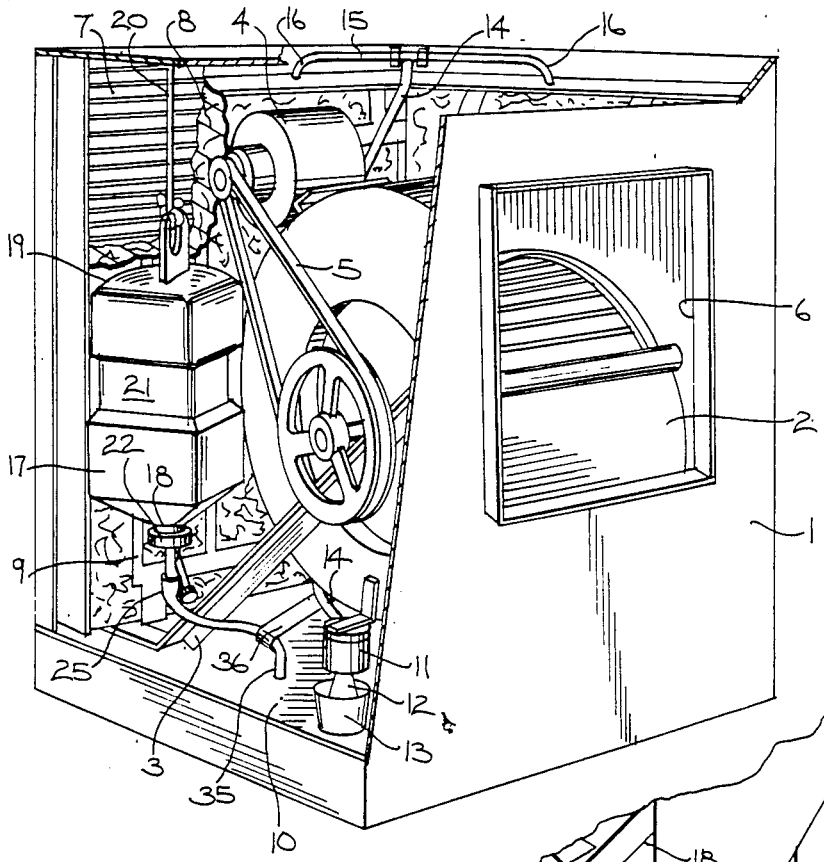
FIG. 1 is a perspective view of a typical evaporative cooler containing the dispensing apparatus of the invention.

FIG. 1 illustrates a typical evaporative cooler incorporating the dispensing system of the invention. The dispensing system acts to automatically dispense controlled amounts of a liquid water treating composition into the reservoir of the cooler. The treating compositon can contain anti-scaling agents, corrosion inhibitors, bacteriacides, algaecides and other active ingredients commonly used in water treating compositions.

The evaporative cooler includes a generally box-like housing 1 and a blower 2 is mounted within the housing through supports 3. Blower 2 is operated by motor 4 acting through belt drive 5.

As shown in FIG. 1, one of the sides of the housing is provided with an outlet 6 through which the air is distributed to the building to be cooled, while the remaining sides of housing 1 can be formed with louvered inlet openings 7. A series of conventional evaporative pads 8 are mounted behind each of the louvered inlets 7, and are held in position by an open metal framework 9.

The lower end of housing 1 defines a reservoir 10 or sump which contains a given quantity of water, and a conventional float operated valve, not shown, is located in the reservoir and acts to supply additional make-up water to the reservoir when the level of water falls beneath a preset value.

A pump 11 having an inlet 12 located within a strainer 13 acts to continuously draw water from reservoir 10 and circulate the water to the evaporative pads. Discharge line 14 is connected to the discharge side of pump 11 and line 14 is connected to one or more manifolds 15 which are located along the upper edge of the housing above the inlets 7. The water being supplied to the manifold 15 by pump 11 is discharged through outlets 16 over the pads 8 and drips downwardly through the pads.

Air being drawn inwardly through the inlet 7 by blower 2 will pass in contact with the water flowing downwardly along the pads 8 to evaporate the water, and the evaporation provides a cooling effect to cool the air which is then discharged through outlet 6 to the building to be cooled.

In accordance with the invention, a dispensing mechanism is incorporated with the evaporative cooler to automatically dispense a controlled amount of the liquid treating composition into the water circulating system. The dispensing mechanism includes a container 17, preferably formed of plastic material, which is mounted in an inverted condition within the housing 1, with the neck or outlet 18 of the container facing donwardly. As shown in FIG. 1, the upper closed end of container 17 is provided with a tab 19, and a cable 20 or rope engages the opening in tab 19 and acts to support the container from the upper surface of housing 1.

As illustrated in FIG. 1, container 17 is provided with a central waist portion 21 of reduced cross-sectional area. The waist stiffens and reinforces the container and prevents the container from collapsing inwardly as the liquid composition is drained from the container.

Figure 2:
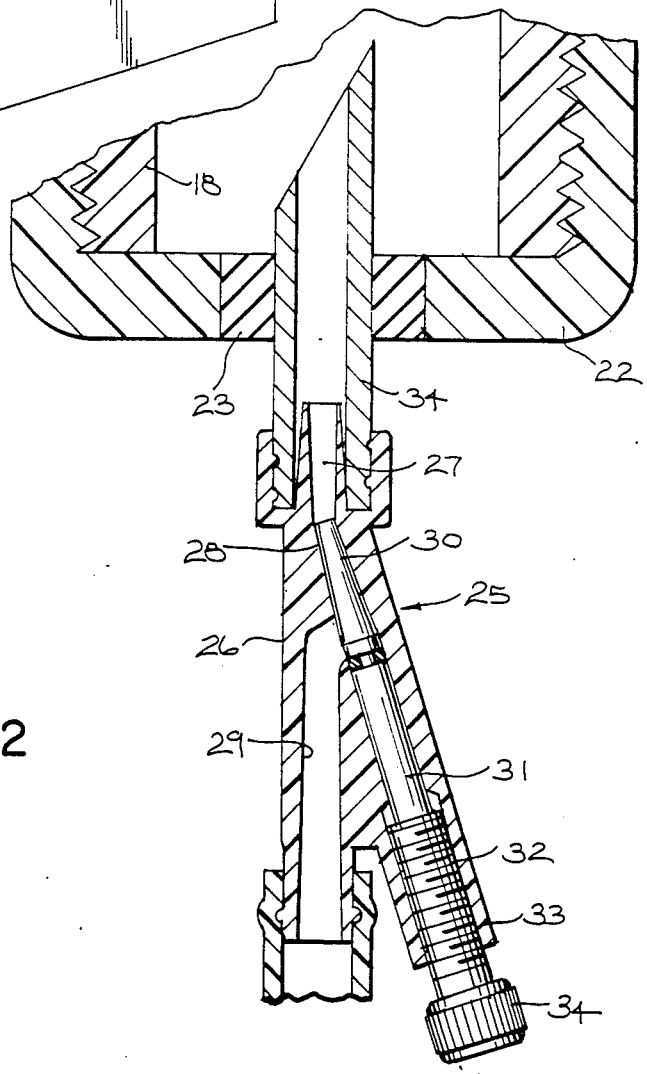
FIG. 2 is a longitudinal section of the needle valve and cap for the container.

As best illustrated in FIG. 2, a cap 22 is threaded on the neck 18 of container 17, and the central portion of cap 22 is provided with an opening which is enclosed by a rubber or resilient plug 23. Extending through central opening in plug 23 in sealed relation is a hollow needle 24 or catheter, and the lower end of the needle 24 is threaded to a needle valve assembly 25 which is located immediately below cap 22.

Needle valve assembly 25 includes a body 26, preferably formed of plastic material, and the body has an inlet passage 27 which communicates with the interior of needle 24. The rear end of inlet passage 27 is connected to a generally conical valve seat 28, and the valve seat communicates with an outlet passage 29 that is disposed in axial alignment with inlet passage 27.

Mounted for movement within the valve seat 28 is a generally conical needle valve 30 which is carried by a stem 31. The outer end of stem 31 is provided with a thread as indicated by 32 which is engaged with the internally threaded bore 33 of body 26. Knob 34 is connected to the outer end of stem 31, and by rotating knob 34, the position of needle valve 30 can be changed to thereby regulate flow of the liquid treating composition through the valve assembly.

One end of a drip line 35 is attached to the outlet passage 29 and the opposite end of the drip line 35 is mounted slightly above the level of water in reservoir 10. Line 35 can be supported in proper position from housing 1 by one or more ties 36. In addition to supporting the drip tube 35, the ties will stabilize the container 17 and drip tube 35, and prevent swinging during high wind conditions.

The invention provides an automatic and controlled gravity feed of the treating composition into the recirculating water system of the cooler. Through the addition of the treating composition, scaling problems can be minimized, corrosion of steel and galvanized components of the cooler can be eliminated and the growth of bacteria and algae can be inhibited.

While the above description has shown the dispensing mechanism associate with an evaporative cooler, it is contemplated that the dispensing system can be utilized in other water systems, as, for example, cooling towers, decorative ponds or fountains, animal feeding troughs, and the like.

Various modes of carrying out the invention are contemplated as being within the scope of the following claims particularly pointing out and distinctly claiming the subject matter which is regarded as the invention.

We claim:

1. An evaporative cooler assembly, comprising a housing having an air inlet and an air outlet, a blower disposed within the housing, a plurality of evaporative pads enclosing said air inlet, a reservoir disposed in the lower portion of said housing, recirculating means for recirculating water from the reservoir and distributing said water to said pads, a container disposed within the housing and having a closed upper end and an outlet in the lower end, said container containing a liquid water treating composition, said container composed of generally flexible material and having a central waist portion of reduced cross section, a cap enclosing said outlet, conduit means having an inner end extending through the cap and having an outer end disposed in spaced relation above the level of water in said reservoir, said composition being fed by gravity from said container through said conduit means to the reservoir, a conical valve seat with a small diameter upper end and a large diameter lower end disposed in said conduit means with the axis of said seat being disposed at an acute angle with respect to the axis of said conduit means, a conical valve means disposed to engage said seat for regulating the flow of said composition through said conduit means, and manually engageable means located outside of said conduit means and operably connected to said valve means for adjusting the position of said valve means.

* * * * *